US005503088A

United States Patent [19]

Hayman

[11] Patent Number: 5,503,088

[45] Date of Patent: Apr. 2, 1996

[54] FLOOR SAFE METHOD AND APPARATUS

[75] Inventor: Gary D. Hayman, Geneva, Fla.

[73] Assignee: Hayman Safe Company, Inc., Oviedo, Fla.

[21] Appl. No.: 172,756

[22] Filed: Dec. 27, 1993

[51] Int. Cl.[6] ..... E05G 1/024

[52] U.S. Cl. ..... 109/50; 109/53; 109/74; 109/77; 109/78; 220/484

[58] Field of Search ..... 109/50–54, 58, 109/59, 59 T, 74, 77, 78, 73; 52/220.5; 220/484, 477

[56] References Cited

U.S. PATENT DOCUMENTS

| | | | |
|---|---|---|---|
| 9,305 | 7/1880 | Heineman | 109/54 X |
| 545,163 | 8/1895 | King | 109/59 |
| 793,132 | 6/1905 | Hibbard | 109/59 |
| 1,471,517 | 10/1923 | Kline | 109/59 |
| 4,176,440 | 12/1979 | Lichter | 29/458 |
| 4,327,651 | 5/1982 | Novakosky | 109/68 |
| 4,408,545 | 10/1983 | Lichter | 109/50 |
| 4,408,546 | 10/1983 | Schmidt | 109/75 |
| 4,574,454 | 3/1986 | Dyson | 109/65 X |
| 4,593,816 | 6/1986 | Langenbeck | 220/532 X |
| 4,628,827 | 12/1986 | Litter | 109/50 |
| 4,712,490 | 12/1987 | Lichter | 109/73 X |
| 4,715,297 | 12/1987 | Lichter | 109/50 |

FOREIGN PATENT DOCUMENTS

| | | | |
|---|---|---|---|
| 243896 | 4/1963 | Australia | 109/73 |
| 220078 | 3/1910 | Germany | 109/50 |
| 8702498 | 5/1989 | Netherlands | 109/50 |

*Primary Examiner*—Lloyd A. Gall
*Attorney, Agent, or Firm*—William M. Hobby, III

[57] ABSTRACT

A floor safe apparatus has a polymer floor safe housing formed in one piece with an entry opening thereinto and has at least one storage self for supporting a storage container thereon formed into the side of the housing. The storage shelf has an exterior open area therearound for cement fill to lock the floor safe in place. A safe door frame is shaped to fit into the opening in the polymer safe housing and to a ledge formed in the housing and to be locked in place with threaded fasteners extending into a groove formed in the housing. The safe door is shaped to fit into the safe door frame for opening relative to the frame to form a watertight molded polymer floor safe housing having built-in storage compartments and a removable safe door. The molded housing can have a plurality of ridges for inserting partitioning members supported in the grooves of the ridges. The process includes the forming a safe in accordance with the apparatus, mounting the safe door frame in place with threaded fastening members, positioning the housing in an opening in a building floor, pouring concrete around the exterior of the polymer floor safe body, and attaching the safe door.

13 Claims, 2 Drawing Sheets

FLOOR SAFE METHOD AND APPARATUS

BACKGROUND OF THE INVENTION

This invention relates to floor safes and especially to a floor safe having a molded polymer housing with detachable metal door frame and door.

There have been numerous prior art floor safes for imbedding into concrete. Such safes are generally manufactured with a metal safe body which can be cylindrical or square with a door attached thereto for positioning into a hole cut in the floor of a building and to which concrete has been poured therearound to prevent the removal of the safe from the floor. To assure that the safe cannot be removed from the concrete, it has been customary to have extensions, such as steel bars or reinforcing rebar, extend from the floor safe with concrete poured therearound. Such prior art safes are expensive to manufacture and expensive and bulky to ship and store and will corrode with moisture from the concrete. These safes typically are a box having a safe door and are opened to place jewelry or other valuables on the floor of the box for storage therein. Floor safes may include fire doors with various types of seals and the like for preventing the ingress of moisture and sometimes have means to prevent moisture from contacting the metal safes to prevent corrosion of the safe bodies.

In contrast to floor safes, wall safes are particularly subject to the hazards of fire but are not generally subject to water damage. Floor safes are not as susceptible to damage from fire since the floor foundation does not typically reach the hot temperature found in the remainder of a burning building. Floor safes, on the other hand, are subject to water intrusion into the safe and around the safe where it can cause corrosion to the safe body or damage to the contents of the safe. Thus, it is desirable in a floor safe to make the housing watertight and some safes provide seals for the door of the floor safe to make it watertight.

The present invention forms a safe body of a one piece molded polymer or plastic material which is locked in place by the poured concrete around the exterior of the safe body. Exterior grooves are filled with concrete to prevent the removal of the safe body which grooves are also used in the formation of storage compartments for holding storage containers. The molded body also advantageously has molded corrugations for partitioning the interior and has means for anchoring a door frame thereto.

Prior U.S. patents can be seen in my prior patent for a Safe Apparatus, U.S. Pat. No. 4,532,870, which is a security safe apparatus and specifically a floor safe having a safe door cover which is opened and closed on a door hinge which includes a hinge pin nested in a grooved pin support so that the door can be removed by unlocking the door and hinging it open and lifting the door from the container. The present floor safe contemplates the use of a similar type floor safe door. In the U.S. patents to Lichter, U.S. Pat. Nos. 4,408,545 and 4,176,440, a floor safe is provided which uses a plastic body having a plurality of slots precision saw cut into the sides thereof for sliding steel bars to protrude therefrom to lock the safe body in place once the concrete is poured around the plastic liner and around the steel bars. These safes also provide for special concrete door covers over a safe door and use the steel bars in the slots to help support the safe door and in the operation of the lock. A third Lichter patent, U.S. Pat. No. 4,715,297, uses a safe construction using rebar coupled to a frame and having a body coupled thereto for anchoring the frame and body into a floor and has a special door attaching frame and door. In the Litter U.S. Pat. No. 4,628,827, a storage vault is provided for valuables and includes a floor storage container having conventional flanges for anchoring the body into concrete. Special seals are provided for sealing the entrance against the intrusion of moisture. This container also has a plurality of ribs attached along the edge for inserting divider walls for breaking the safe into compartments. The Novakosky patent, U.S. Pat. No. 4,327,651, is a method and apparatus for protecting a floor safe from water damage and shows a conventional floor safe along with a method for protecting the floor safe from water damage.

In contrast to the prior patents, the present apparatus and method utilizes one molded polymer body or housing having corrugations for breaking up a portion of the inside of the body with partition walls but also has a plurality of molded side compartments for the placement of storage containers. These compartments along with a protruding locking groove allow the concrete poured on the exterior of the molded body to seep around and into exterior grooves and surfaces formed by the molded body to lock the body in place without the use of steel bars and flanges. The safe also provides a convenient and easily attachable door for attaching to the safe body once the body is attached into a concrete floor.

SUMMARY OF THE INVENTION

A floor safe apparatus has a polymer floor safe housing formed in one piece with an entry opening thereinto and has at least one storage shelf for supporting a storage container thereon formed into the side of the housing. The storage shelf has an exterior open area therearound for cement fill to lock the floor safe in place. A safe door frame is shaped to fit into the opening in the polymer safe housing. A ledge is formed in the housing for the door frame to rest upon. The door frame is locked in place with threaded fasteners extending into a groove formed in the housing. The safe door is shaped to fit into the safe door frame for opening relative to the frame whereby a watertight molded polymer floor safe housing has built-in storage compartments and a removable safe door. The molded housing can have a plurality of ridges for inserting partitioning members supported in the grooves of the ridges. The process includes the forming of a safe in accordance with the apparatus, mounting the safe door frame in place with threaded fastening members, positioning the housing in an opening in a building floor, pouring concrete around the exterior of the polymer floor safe body and into the exterior grooves, and attaching the safe door.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
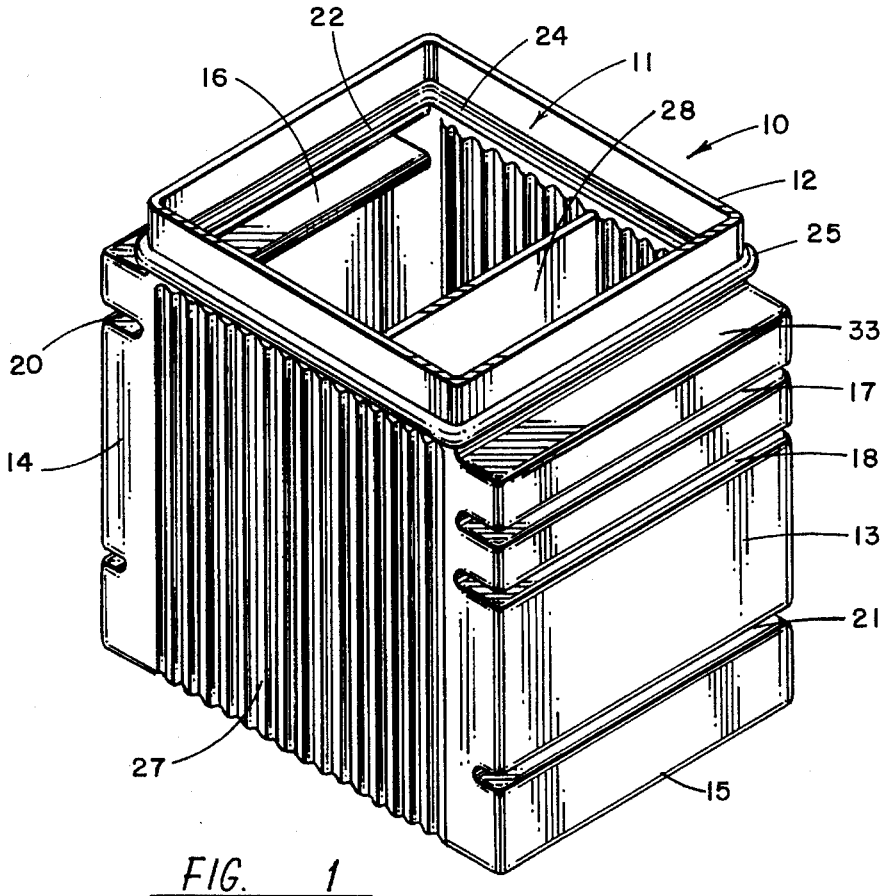
FIG. 1 is a perspective view of a floor safe molded plastic housing in accordance with the present invention.
Figure 2:
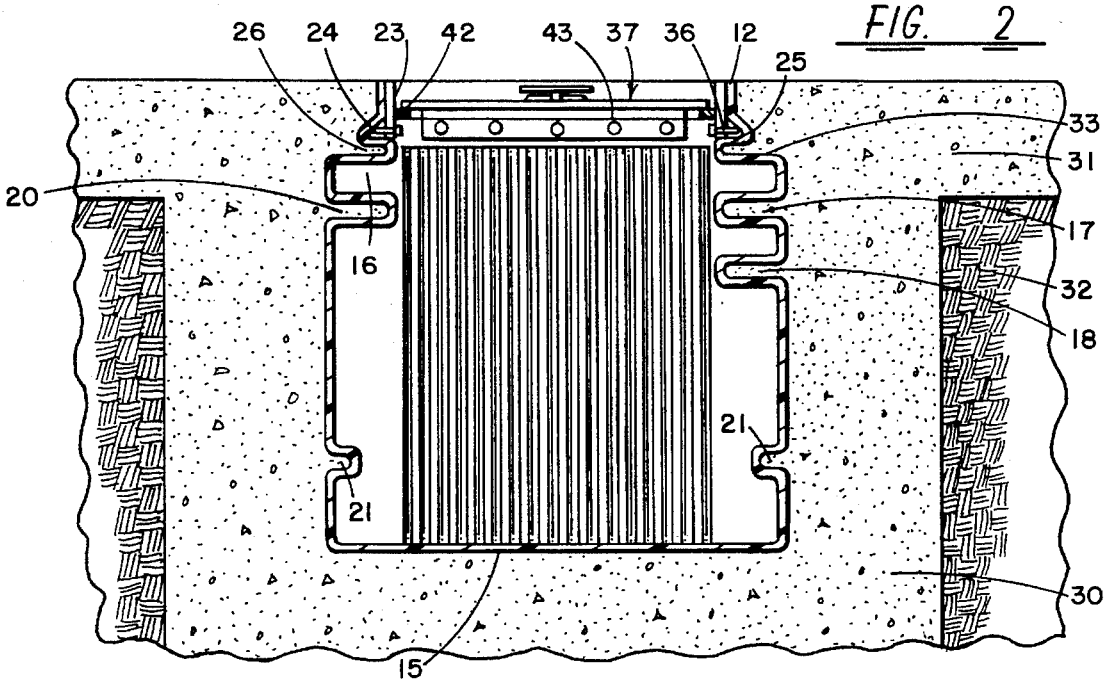
FIG. 2 is a sectional view of the safe body of FIG. 1 formed into a concrete floor slab.

Referring to the drawings and especially to FIG. 1, a molded floor safe body or housing 10 has an open top portion 11 with a door flange surround 12 and having an all molded polymer housing 10 which is made of plastic, such as a molded polyethylene polymer. The polymer body 10 is formed with a pair of end walls 13 and a pair of side walls 14 and a bottom 15 and has a pair of storage compartment shelves 16 formed into the end walls 13. The end wall storage shelves are shaped to hold containers of matching size for storage of jewelry and the like in the containers on the shelves. In the process of molding the housing 10, a plurality of grooves 17, 18, and 20 are formed on the exterior of the housing 10 as part of the forming of three separate side storage compartments. In addition, a pair of lower grooves 21 are molded in the sides 13 on either end of the safe body 10 so that an interior sheet can rest thereon and that concrete poured on the exterior of the safe body 10 will flow into the grooves 17, 18, and 20 as well as into the pair of grooves 21. In the forming of the molded body 10, the flange 12 is sized for a door frame to fit therein and has a ledge 22 extending around the opening 11 on the inside body 10 for placing a safe door frame 23, as shown in FIG. 2, thereagainst. A grooved area 24 extends around opening flange 12 on the interior of the body 10 and forms an exterior ledge 25 on the exterior of the body 10 to thereby form an additional groove 26 all the way around the body 10 just below the lip flange 12.

Body 10, as illustrated in FIG. 1, has sides 14 on opposite sides of the body 10 having corrugated surfaces 27 aligned with each other on opposite sides of the inside of the safe body. This allows one or more partitions 28 to be inserted into the grooves formed by the corrugations for breaking the main inside compartment of the safe body 10 into a plurality of compartments spaced by vertically extending partition members 28 which do not interfere with the placing of storage containers in the side storage compartments 16. When the safe body 10 is mounted into concrete 30 of a slab floor 31 over the earth 32, the grooves 21 are filled with the flowing concrete 30 which also flows into the grooves 17, 18 and 20 to prevent the safe body from being broken loose from the top and pulled out of the concrete 30. In addition, the narrowed opening 11 forms a large ledge 33 on either side of the safe body covered with concrete and the protruding ledges 25 of the body also form the groove 26 which allows concrete to form therearound to thereby provide a concrete backing to the polymer groove 24.

The door frame 23, which is a steel member shaped to fit inside of the opening lip 12, is slid in until it abuts against the ledges 22. The frame has a plurality of threaded openings therein having threaded fasteners 36 threaded therethrough which are threaded into the groove 24 to lock the frame 23 in place. The threaded fasteners 36 are located below where the locking door 37 will lock onto the frame. The door frame 23 is installed at the factory and shipped with the safe body.

Figure 4:
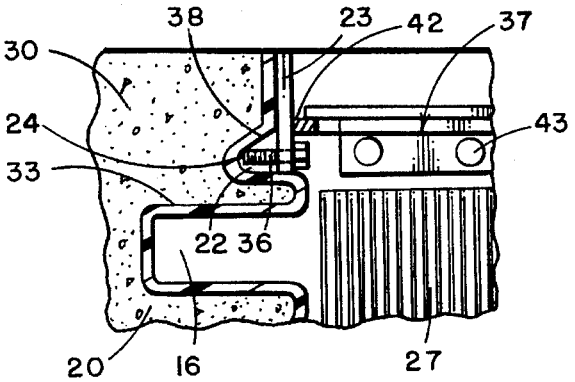
FIG. 4 is a sectional view taken through the safe door frame adjacent a fastener locking the frame to the body.
Figure 3:
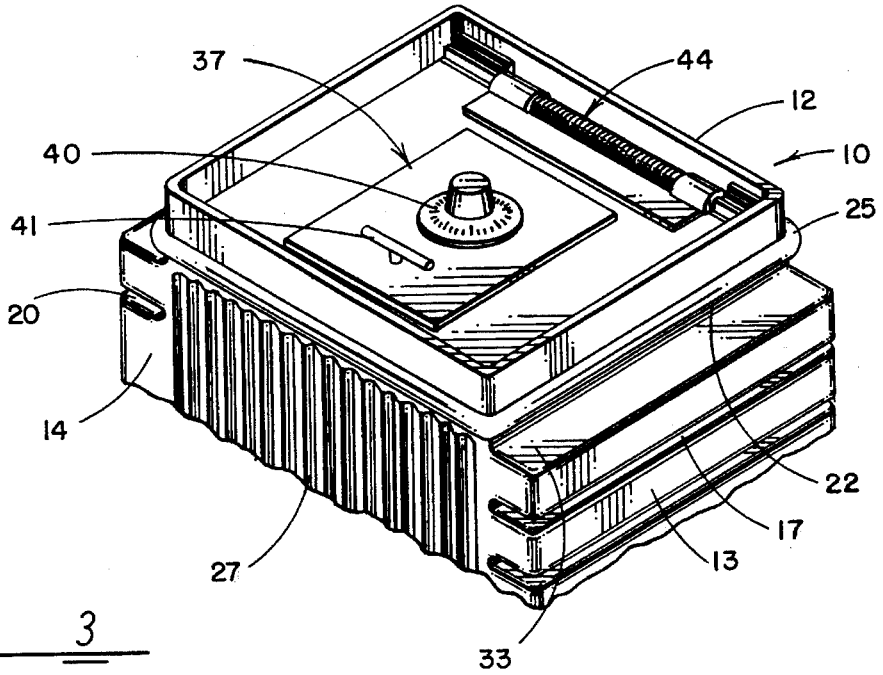
FIG. 3 is a perspective view of the top portion of the floor safe of FIG. 2 having the door frame and door mounted therein.

The groove 24, seen in FIG. 4, has an angled top 38 which allows a degree of latitude for the threaded fasteners 36 to be threaded into place to lock the door frame 23 in place. Once the door frame 23 is locked in place in the floor safe, the door 37 can be mounted into the steel frame at any time, such as after the safe body is installed, and may have a combination or other lock 40 along with a locking handle 41. The door is locked in place by resting on the steel flange 42 around the frame 23 and having the locking bolts 43 slid under the flange 42 to lock the door in place against removal. Door 37 may have a quick removing hinge 44 mounted into a hinge support which can be formed into the frame 23 for rapid removal in accordance with my prior U.S. Pat. No. 4,532,870. Once the door is unlocked with the combination or key, the door can be swung open and rapidly removed. In addition, the door frame 23 can be removed by loosening the threaded fasteners 36 once the door is removed and then sliding the frame out from the body.

Advantages of the present floor safe body include the low cost of making the housing out of a one piece molded polymer material which is water impervious. Since concrete is poured all around the body, entry into the polymer body is prevented by the concrete. The polymer body is less expensive to manufacture and is not subject to the corrosion of a metal body and allows for the additional storage compartments which in turn help anchor the safe body into the concrete by allowing the concrete to flow into the grooves formed in making the compartments.

The process of installing a floor safe includes making a polymer floor safe housing in accordance with the apparatus described hereinbefore, including forming a one piece housing or body with an entry opening thereinto and having at least one storage shelf for supporting a storage container thereon formed into the wall thereof. The storage shelf has an exterior open area therearound on the exterior of the polymer floor safe body for cement fill so that the polymer floor safe body can be sealed by the concrete flooring within the open area to block the body from removal from the floor. A safe door frame, shaped to fit into the body opening, is mounted into the entry opening of the polymer safe housing and is threadedly attached to a grooved area in the floor safe housing. The process includes positioning the polymer floor safe body into an opening in the building floor and then pouring concrete around the exterior of the polymer floor safe body and beneath open areas below the storage shelves and into grooves formed into the exterior to lock the polymer safe body into the concrete. A lockable safe door is then attached to the attached safe door frame so that a floor safe having a polymer body with storage containers is mounted into a poured concrete floor.

It should be clear at this time that both a floor safe having a polymer housing and special storage compartments has been provided along with a method of installing the floor safe. However, the present invention is not to be construed as limited to the forms shown which are to be considered illustrative rather than restrictive.

I claim:

1. A method of installing a floor safe comprising:

making a polymer floor safe housing formed in one piece with an entry opening thereinto and having a plurality of sides and having at least one storage shelf for supporting a storage container thereon formed therein and having said storage shelf having an open area therearound on the exterior of said polymer floor safe housing for cement fill and further having a plurality of grooves formed in said polymer floor safe housing for cement fill whereby said polymer floor safe housing can be sealed in concrete and blocked against removal;

selecting a safe door frame shaped to fit into the entry opening in said polymer safe housing;

mounting said selected safe door frame in said polymer safe housing;

threadedly attaching said safe door frame to an open area in said polymer floor safe housing;

positioning said polymer floor safe housing in an opening in a building floor;

pouring concrete around the exterior of said polymer floor safe housing and around said open area around said storage shelf; and attaching a lockable safe door shaped to fit into said safe door frame, whereby a floor safe having a polymer body is mounted into a building floor.

2. A method of installing a floor safe in accordance with claim 1 which the step of making a polymer floor safe housing includes making a polymer floor safe housing having a ledge formed therein for said safe door frame to rest upon.

3. A method of installing a floor safe in accordance with claim 2 in which the step of making a polymer floor safe housing includes making a polymer floor safe housing having an open area in said polymer safe housing formed in one side thereof adjacent said safe door frame having an angled edge for receiving threaded members thereagainst.

4. A method of installing a floor safe in accordance with claim 2 in which the step of selecting a safe door frame includes selecting a safe door frame having a plurality of threaded openings therethrough located beneath said safe door.

5. A method of installing a floor safe in accordance with claim 4 in which the step of making a polymer floor safe housing includes making a polymer floor safe housing having a plurality of side storage compartments formed therein.

6. A method of installing a floor safe in accordance with claim 5 in which the step of making a polymer floor safe housing includes making a polymer floor safe housing having a plurality of vertical corrugations formed therein and at least one partition member sized to fit into said housing vertical corrugations to break said floor safe into a plurality of compartments.

7. A floor safe comprising:

a polymer floor safe housing formed in one piece with an entry opening thereinto and having a plurality of sides and having at least one storage shelf for supporting a storage container thereon formed therein and having said storage shelf having an open area therearound on the exterior of said polymer floor safe housing for cement fill and said polymer floor safe housing having a plurality of grooves formed in the exterior thereof to receive cement fill therein whereby said polymer floor safe housing can be sealed in concrete and blocked against removal;

a safe door frame shaped to fit into the opening in said polymer safe housing;

a safe door shaped to fit into said safe door frame and to be opened relative to said door frame, said safe door having a lock for locking said safe door to said safe door frame, whereby a watertight floor safe has built in storage compartments and an easily attached and removed safe door; and said polymer floor safe housing having an open area formed in one side thereof adjacent said safe door frame and said safe door frame having a plurality of threaded openings therein and each said threaded opening having a threaded locking member threaded into each said threaded opening and into said open area formed in the side of said polymer floor safe housing whereby said safe door frame is removably locked to said polymer floor safe housing.

8. A floor safe in accordance with claim 7 in which said safe door frame is a steel metal door frame.

9. A floor safe in accordance with claim 7 in which said polymer floor safe housing having an open area formed in the side thereof adjacent said safe door frame includes a ledge formed therebeneath for supporting said safe door frame.

10. A floor safe in accordance with claim 9 in which said polymer floor safe housing having an open area formed in the side thereof adjacent said safe door frame has an angled edge for receiving said threaded members thereagainst.

11. A floor safe in accordance with claim 10 in which said safe door frame plurality of threaded openings are located beneath said safe door.

12. A floor safe in accordance with claim 11 in which said polymer floor safe housing has a plurality of side storage compartments formed therein.

13. A floor safe in accordance with claim 12 in which said polymer floor safe housing has a plurality of vertical slots formed therein and at least one partition member sized to fit into said housing vertical slots to break said floor safe into a plurality of compartments.

* * * * *